US010710679B2

(12) United States Patent
Zykov et al.

(10) Patent No.: US 10,710,679 B2
(45) Date of Patent: Jul. 14, 2020

(54) INFLATABLE MOTOR BOAT WITH MOTOR MOUNT

(71) Applicants: Stanislav Vladimirovich Zykov, Novosibirsk (RU); Mihail Viktorovich Losev, Novosibirsk (RU); Sergej Valer'evich Chesnokov, Novosibirsk (RU)

(72) Inventors: Stanislav Vladimirovich Zykov, Novosibirsk (RU); Mihail Viktorovich Losev, Novosibirsk (RU); Sergej Valer'evich Chesnokov, Novosibirsk (RU)

( * ) Notice: Subject to any disclaimer, the term of this patent is extended or adjusted under 35 U.S.C. 154(b) by 0 days.

(21) Appl. No.: 15/768,777

(22) PCT Filed: Oct. 19, 2015

(86) PCT No.: PCT/RU2015/000683
§ 371 (c)(1),
(2) Date: Apr. 16, 2018

(87) PCT Pub. No.: WO2017/069645
PCT Pub. Date: Apr. 27, 2017

(65) Prior Publication Data

US 2018/0297668 A1 Oct. 18, 2018

(51) Int. Cl.

| | |
|---|---|
| ***B63B 7/08*** | (2020.01) |
| ***B63B 1/04*** | (2006.01) |
| ***B63H 20/02*** | (2006.01) |

(52) U.S. Cl.
CPC ..... *B63B 7/08* (2013.01); *B63B 1/042* (2013.01); *B63B 7/085* (2013.01); *B63H 20/02* (2013.01)

(58) Field of Classification Search
CPC ..... B63B 1/042; B63B 2001/201; B63B 2001/202; B63B 7/08; B63B 7/082; B63B 7/085; B63B 7/087
See application file for complete search history.

(56) References Cited

U.S. PATENT DOCUMENTS 2,698,447 A * 1/1955 Potts ..... B63B 7/087 114/345
3,469,557 A * 9/1969 Wollard ..... B63B 1/20 114/355

(Continued)

FOREIGN PATENT DOCUMENTS

RU 2150401 C1 6/2000
RU 145840 U1 9/2014

OTHER PUBLICATIONS

English abstract of RU 145840 U1, downloaded from Espacenet on Jun. 23, 2019.*

*Primary Examiner* — Ajay Vasudeva
(74) *Attorney, Agent, or Firm* — Muncy, Geissler, Olds & Lowe, P.C.

(57) ABSTRACT

An inflatable boat with a motor mount for use in shallow water conditions. The inflatable boat with the motor mount has a U-shaped hull in plan view, which is formed by open outline of inflatable boards and nose, as well as a transom installed on the boat stern and an inflatable bottom attached to the hull from below, and which bottom has an axissymmetric groove laying longitudinally from the stern end. The groove is V-shaped in cross-section. The depth of the groove is reduced uniformly in direction to the bottom nose. The inflatable boat according to the present invention allows expansion of usage specifications of the inflatable boats with motor mount, provides an additional guard for the outboard (Continued)

motors installed on them against possible mechanical damages and lowers fuel consumption in comparison with the boats of similar design.

2 Claims, 1 Drawing Sheet

(56) References Cited

U.S. PATENT DOCUMENTS

| | | | | | |
|---|---|---|---|---|---|
| 4,528,927 | A | | 7/1985 | Iizuka | |
| 4,713,028 | A | * | 12/1987 | Duff | B63H 20/106 248/641 |
| 4,915,668 | A | * | 4/1990 | Hardy | B63H 5/16 114/288 |
| 5,934,218 | A | * | 8/1999 | Chen | B63B 1/042 114/288 |
| 6,024,042 | A | | 2/2000 | Eilert | |
| 6,406,341 | B1 | * | 6/2002 | Morejohn | B63B 1/042 114/288 |
| 7,424,859 | B1 | * | 9/2008 | Clancey | B63H 5/16 114/289 |

* cited by examiner

INFLATABLE MOTOR BOAT WITH MOTOR MOUNT

CROSS-REFERENCE TO RELATED APPLICATIONS

This nonprovisional application is a National Stage of International Application No. PCT/RU2015/000683, which was filed on Oct. 19, 2015, and which is herein incorporated by reference.

BACKGROUND OF THE INVENTION

Field of the Invention

A utility model belongs to water-borne vehicles, in particular, to the outboard motor inflatable rafts that are used in low water conditions.

Description of the Background Art

There are various inflatable boats (e.g. refer to patents issued in Russian Federation, as follows: #71623, IPC B63B7/08, published on Mar. 20, 2008; #2287449, IPC B63B7/08, published on Nov. 20, 2006; #2360824, IPC B63B7/08, published on Jul. 10, 2009), that contain a U-shaped hull in plan view, which is formed by open outline of inflatable boards and nose, as well as an inflatable bottom attached to the hull from below and a transom installed on the boat stern.

Existing inflatable boats that are used for boating and recreational activities have an essential limitation. An outboard motor installed on existing inflatable boats is a water propeller. The normal operation of such water propeller provided by its position below the boat bottom, thereby limiting its application and preventing the boat to be tied to banks in low water conditions.

There is inflatable boat with motor mount (refer to the U.S. Pat. No. 2,389,633, IPC B63B7/08, published on May 20, 2010 in Russian Federation), that contains a U-shaped hull in a plan view, which is formed by open outline of inflatable boards and nose, as well as a transom installed on the boat stern and an inflatable bottom attached to the hull from below with the end deadrise angle from 0° to 50°, and with the flat stern end itself.

The inflatable boat with outboard mount described above, has necessary and sufficient water resistance at the water flow separation point of the inflatable bottom stern end at the moment of transition onto plane and in the boat planning mode, which in turn allows high moving speed with no loss of stability.

However, this boat design also provides no solution of the problem of the motor mount use in low water conditions and when tying the boat to a bank, because the motor propeller with such bottom configuration of the boat is located below the bottom. In addition, this configuration of the boat motor mount could result in possible propeller damages caused by different stock under water during boating.

The inflatable boat with motor mount, which is the most similar to the declared solution in terms of design and of technical result is one (refer to patent RU145840, IPC B63B7/08 published on Sep. 27, 2014), that contains U-shaped hull in plan view, which is formed by open outline of inflatable boards and nose, as well as a transom installed on the boat stern and an inflatable bottom attached to the hull from below, and which bottom has axissymmetric groove on the face in contact with water; the groove with specified dimensions and geometric shape lays longitudinally from the stern end.

The design of existing boat allows using it in various conditions, namely, in low water, in water bodies with high number of sunken wood, and the like.

However, the range of dimensions of the axissymmetric groove made in the bottom of existing boat is not optimal in terms of water resistance while moving, which results in extra fuel consumption.

Accordingly, the goal of the present invention is to reduce fuel consumption while preserving the boat usage specifications.

The advantages of the present invention is the reduction of fuel consumption during the use of boat in low and very low water conditions.

SUMMARY OF THE INVENTION

The object of the present invention is achieved because the inflatable boat with motor mount, containing U-shaped hull in plan view, which is formed by open outline of inflatable boards and nose, as well as a transom installed on the boat stern and an inflatable bottom attached to the hull from below, and which bottom has axissymmetric groove laying longitudinally from the stern end; the groove is V-shaped in cross-section, the depth hereof is reduced uniformly in direction to the bottom nose, the length of the groove is 5 to 20% of one of the boat bottom, the angle of the groove inclined plane does not exceed 30°, and the angular opening of the groove lateral sides does not exceed 45° relative to vertical line.

At the same time the groove width at the bottom stern end can be 20 to 60 cm.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION

Figure 1:
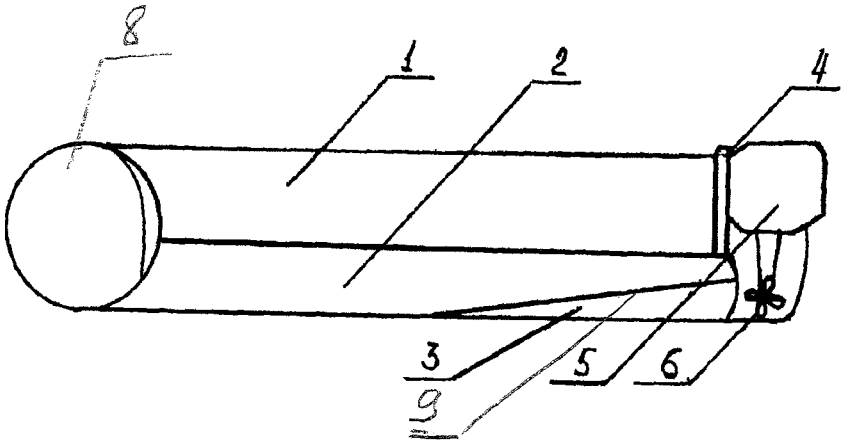
FIG. 1 shows longitudinal vertical section of the boat with outboard motor mount installed, side view.
Figure 2:
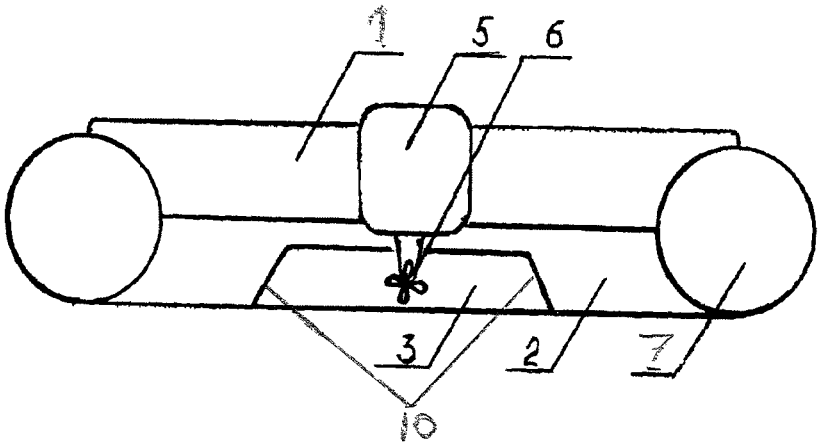
FIG. 2 shows the boat stern rear view.

FIG. 1 illustrates an embodiment of the present invention where an inflatable boat with motor mount contains a hull 1, an inflatable bottom 2 with groove 3 and a transom 4 with outboard motor 5 with water propeller 6 installed on it.

The groove 3 in the inflatable bottom 2 provides for water flowing upward with certain angle while the boat is moving, thus water is flowing in the required amount directly to the propeller 6 of the outboard motor 5 secured to the transom 4. This enables using of motors with a shorter leg and arrangement of the propeller 6 closer to the water surface above the stern draft of the boat itself. Meanwhile, the general draft of the vessel is reduced, that enables using hereof on shallows, in low water conditions, etc. Moreover, the hull 1 and the bottom 2 of the inflatable boat serve as a guard for the propeller 6 arranged behind and a bit higher, against possible mechanical damages caused by rocks, sunken wood and other stock under water.

The boats with declared geometric dimensions of the groove 3 have demonstrated 3% lower fuel consumption relative to the boats with geometric dimensions of the groove designed beyond the declared ranges.

The boat according to the disclosed embodiment of the present invention allows expansion of usage specifications of the inflatable boats with motor mount, provides an additional guard for the outboard motors installed on them against possible mechanical damages and lowers fuel consumption.

The invention claimed is:

1. The inflatable boat with motor mount, comprising:

a U-shaped hull in plan view, wherein the hull is formed by open outline of inflatable boards and a nose, and a transom mounted on a boat stern and an inflatable bottom attached to the hull from below, the bottom having an axisymmetric groove laying longitudinally from a stern end;

wherein the groove is V-shaped in cross-section, wherein the depth of the groove is reduced uniformly in direction of the hull nose, wherein the length of the groove is from 5 to 20% of the length of the boat bottom, an angle of a groove inclined plane is about 30°, wherein an angle of groove lateral sides are about 45° relative to a vertical plane.

2. The inflatable boat with motor mount according to claim 1, wherein width of the groove at the stern end is 20 to 60 cm.

* * * * *